US007198518B1

(12) United States Patent
Liou

(10) Patent No.: US 7,198,518 B1
(45) Date of Patent: Apr. 3, 2007

(54) SATELLITE SIGNAL RECEIVER USED WITH BLUE TOOTH TRANSMISSION AND ELECTRONIC MAPS

(75) Inventor: Chii-Moon Liou, Taipei Hsien (TW)

(73) Assignee: Haicom Electronics Corp., Jhonghe, Taipei County 235 (TW)

( * ) Notice: Subject to any disclaimer, the term of this patent is extended or adjusted under 35 U.S.C. 154(b) by 0 days.

(21) Appl. No.: 11/353,193

(22) Filed: Feb. 14, 2006

(51) Int. Cl.
*H01R 24/00* (2006.01)
*H01R 3/00* (2006.01)

(52) U.S. Cl. ..... 439/630; 439/165; 439/946

(58) Field of Classification Search ..... 439/13, 439/165, 630, 638, 946
See application file for complete search history.

(56) References Cited

U.S. PATENT DOCUMENTS 6,174,205 B1 * 1/2001 Madsen et al. ..... 439/638
6,626,703 B2 * 9/2003 Hsin ..... 439/638
6,979,214 B1 * 12/2005 Liou ..... 439/165
6,994,568 B2 * 2/2006 Huang et al. ..... 439/76.1
7,052,312 B2 * 5/2006 Liou ..... 439/529

* cited by examiner

*Primary Examiner*—James R. Harvey

(57) ABSTRACT

A satellite signal receiver used with blue tooth transmission and electronic maps comprises a box having one end extended with a shaft; two ends of the shaft having two connecting ends, respectively; a Blue tooth satellite receiver installed in the box; a lower cover having two connecting ends at one side thereof; an upper cover assembled with the lower cover so as to form an inserting card; one side of the upper cover being formed as a cambered concave edge; when the upper cover is assembled to the lower cover; the cambered concave edge is formed as an opening for receiving an SD card; and a terminal retainer received in the space between the upper cover and the lower cover; two ends of the terminal retainer being extended with respective power wires which are extended to the lower cover so as to supply power to the SD card.

1 Claim, 10 Drawing Sheets

SATELLITE SIGNAL RECEIVER USED WITH BLUE TOOTH TRANSMISSION AND ELECTRONIC MAPS

FIELD OF THE INVENTION

The present invention relates to satellite receivers, and particularly to a satellite signal receiver used with blue tooth transmission and electronic maps, wherein the signals of an electronic map with a large memory space and the Blue tooth satellite receiver are integrated to a handhold mobile device.

BACKGROUND OF THE INVENTION

With reference to FIG. 1, the prior art handhold mobile devices, such as smart phones and personal digital assistant 1, have a tendency of having compact size and light weight. The interfere cards used are SD cards (secured digital cards) instead of the PCMCIA cards or compact flash cards. For example, receivers 11 of the global positioning system uses SD cards, or MMCs (multi-media cards) instead of the PCMCIA cards or compact flash cards.

The handhold mobile device has a compact size. Thus, generally it has only one slot for receiving for example, a SD card or an MMC or a memory stick card, while a general satellite receiver 11 must be used with electronic map which needs a larger amount memory space. Thereby the map cannot be contained in the handhold mobile device. The user stores the electronic map in the SD card or an MMC or a memory stick card. However since the slot has received the memory and thus it can be used with the satellite receiver 11. Thereby the user can only select to use the memory card 10 singly or use the satellite receiver singly. They cannot be used at the same time.

SUMMARY OF THE INVENTION

Accordingly, the primary object of the present invention is to provide a satellite signal receiver used with blue tooth transmission and electronic maps, wherein the signals of an electronic map with a large memory space and the Blue tooth satellite receiver are integrated to a handhold mobile device.

TO achieve above object, the present invention provides a satellite signal receiver used with blue tooth transmission and electronic maps. When the SD card is not installed, it is functioned as a purely external-connected satellite receiver. The power wires serves to supply power to a handhold mobile device from a contact point at the connecting end. Furthermore, the power from the power wires can be supplied to the Blue tooth satellite receiver. When the SD card is inserted into the opening, the guide arm will be pressed by the SD card so that the contact arm is separated from the terminal retainer. Meanwhile, the guide arm will electronically contact the contact point at a front surface of the SD card. When the inserting card with the Blue tooth satellite receiver is inserted into the slot of the handhold mobile device, the handhold mobile device can read data in the Blue tooth satellite receiver. When the SD card is inserted into the opening of the inserting card, the handhold mobile device will read the data of electronic map stored in the SD card; and then the Blue tooth satellite receiver transfers satellite signals to the handhold mobile device wirelessly. Thereby the electronic map is used with the satellite function.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
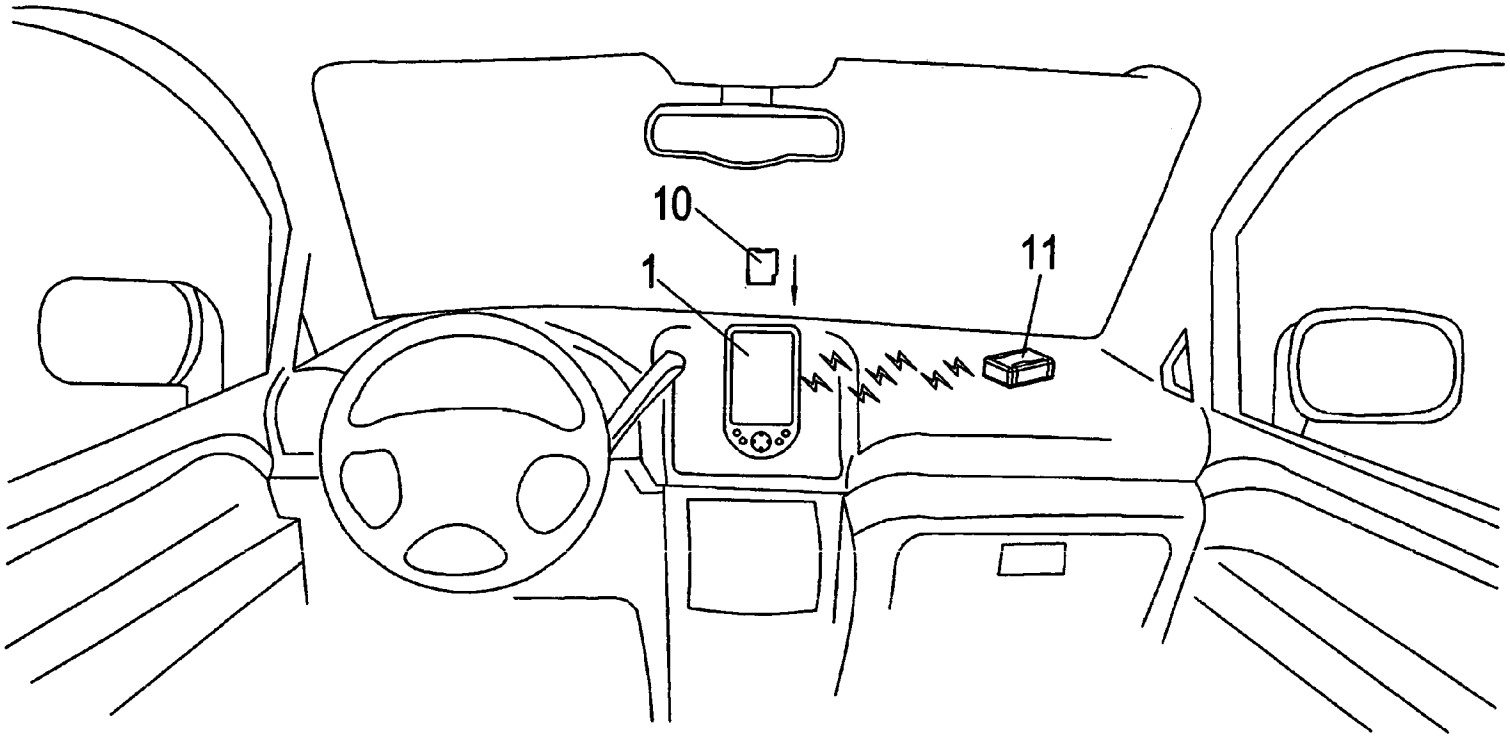
FIG. 1 (PRIOR ART)
FIG. 1 is a function view about the use of the prior art electronic map and satellite function.
Figure 2:
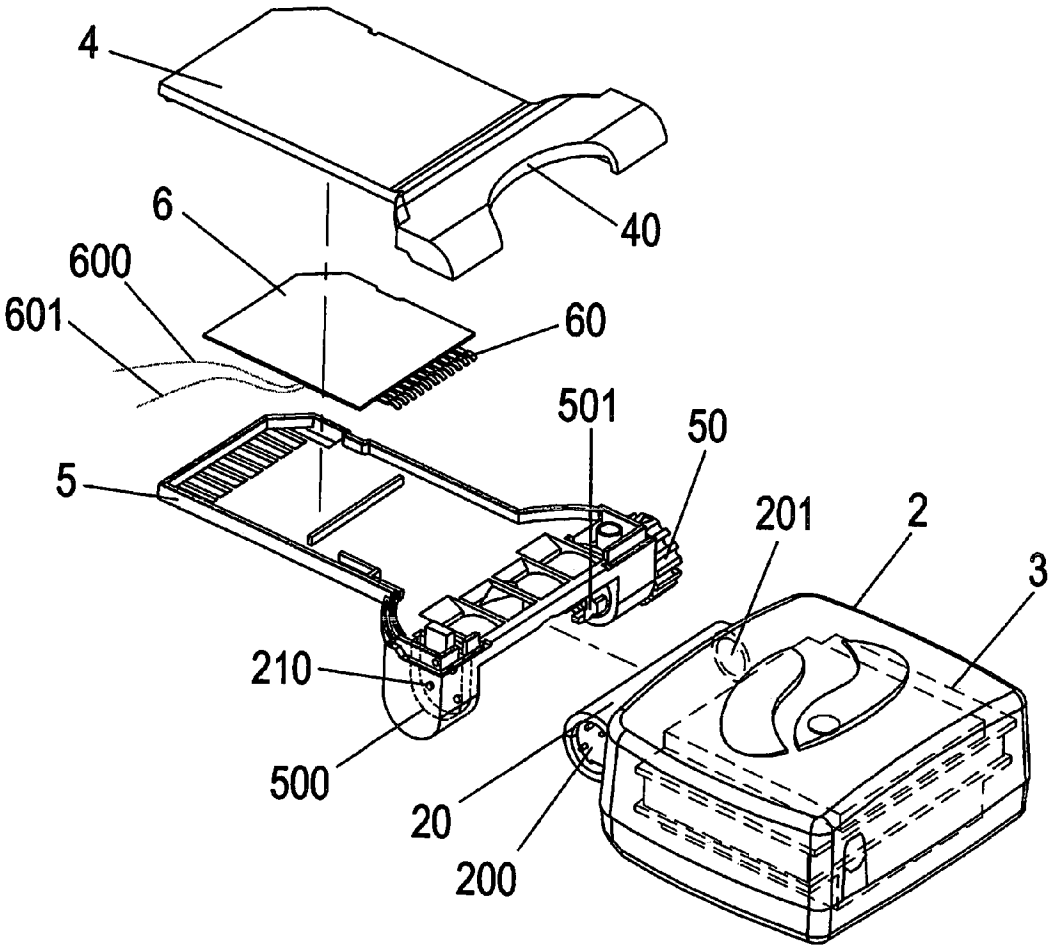
FIG. 2 is an exploded schematic view of the present invention.
Figure 3:
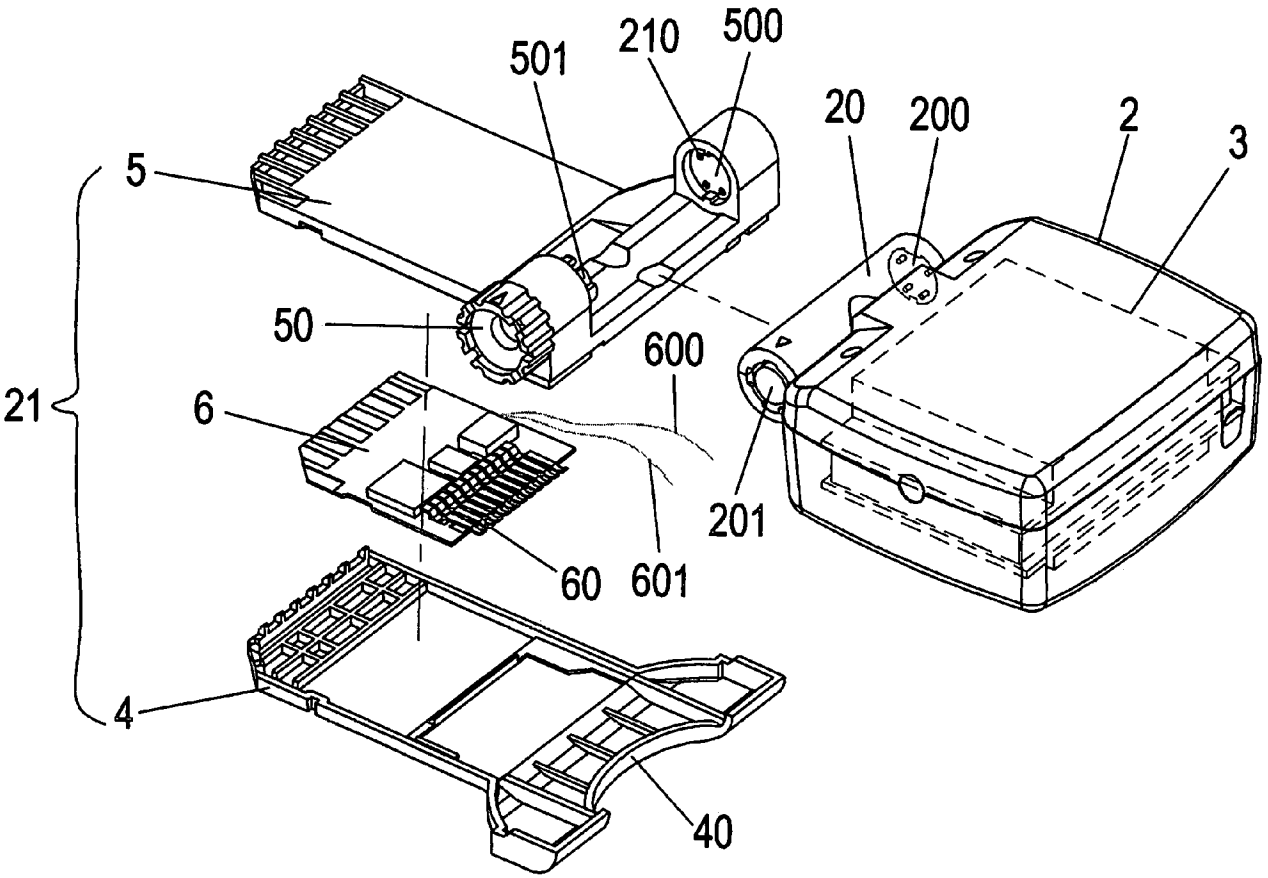
FIG. 3 is another exploded schematic view of the present invention.
Figure 4:
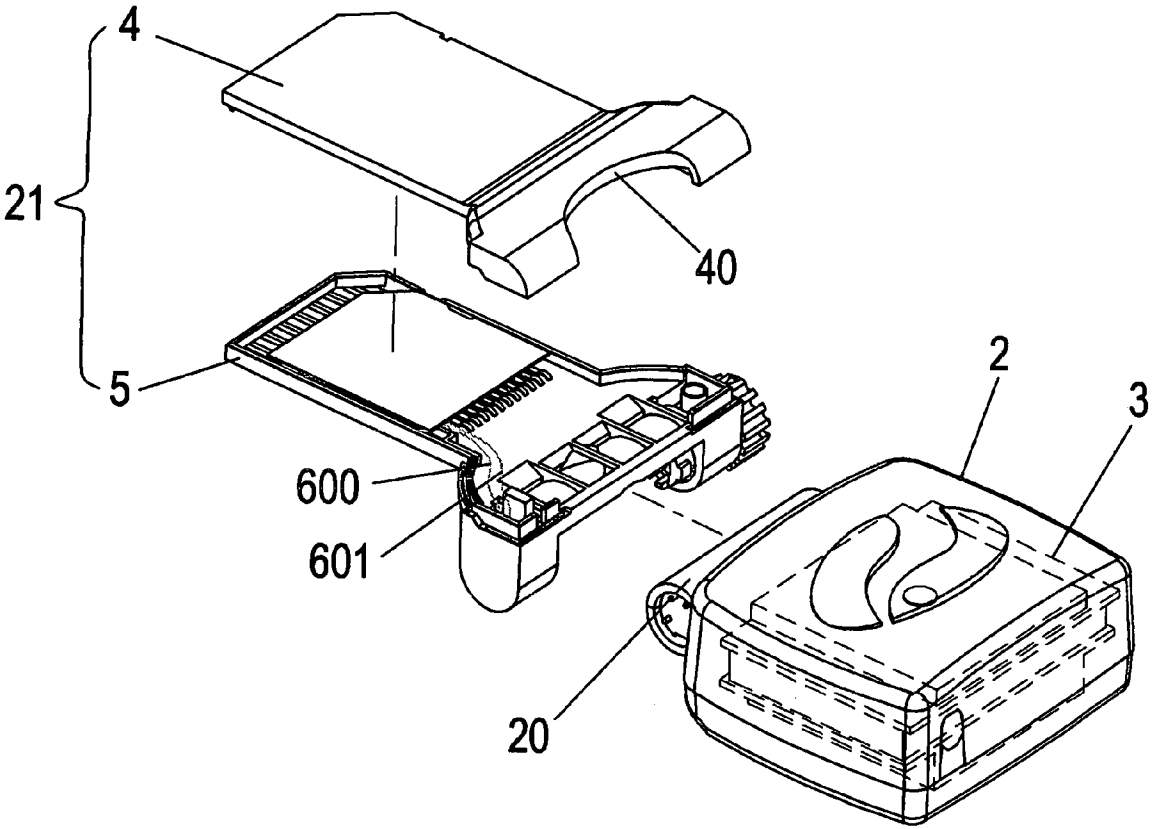
FIG. 4 is a partial assembly view of the present invention.
Figure 5:
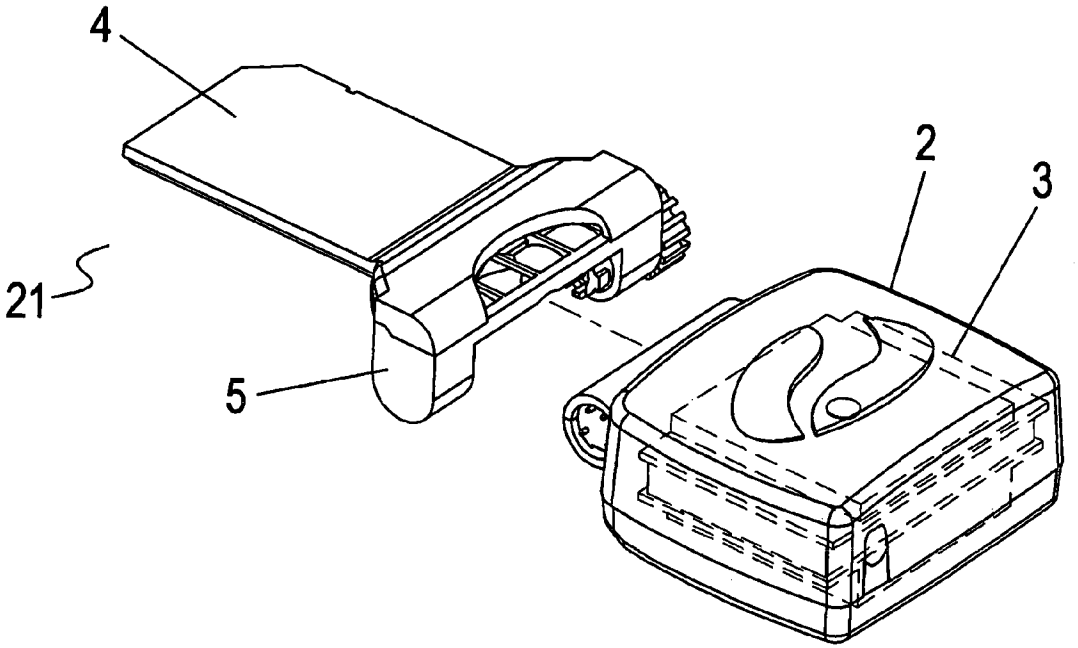
FIG. 5 is another partial assembly view of the present invention.
Figure 6:
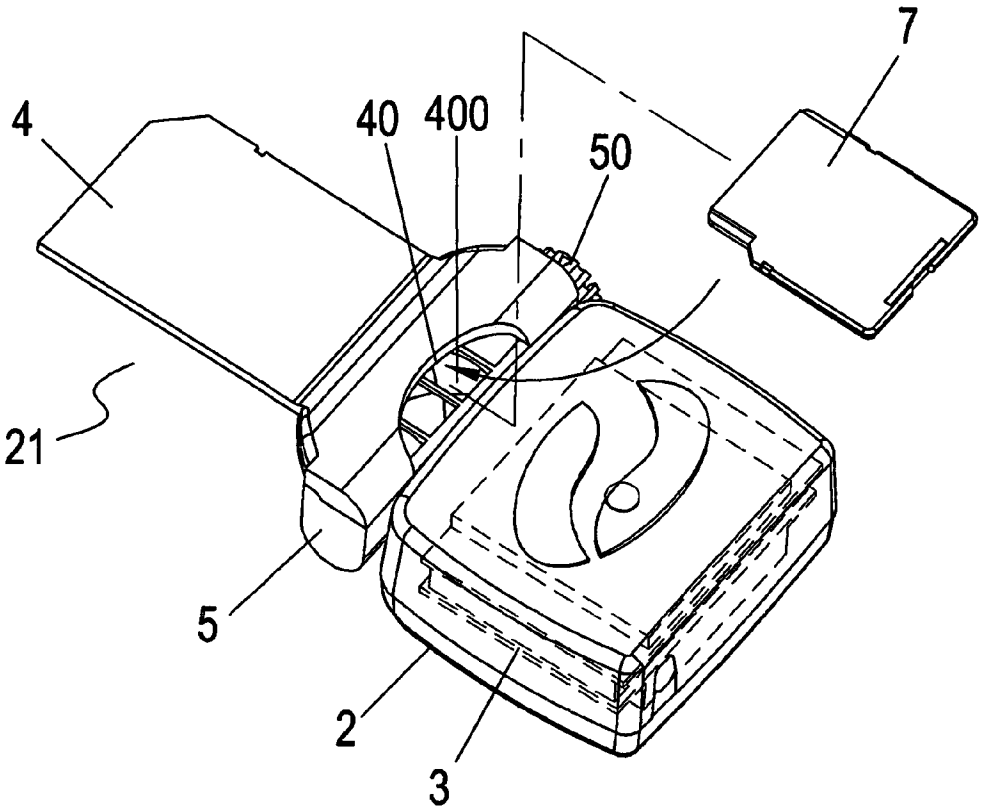
FIG. 6 is a perspective view of the present invention before insertion operation.
Figure 7:
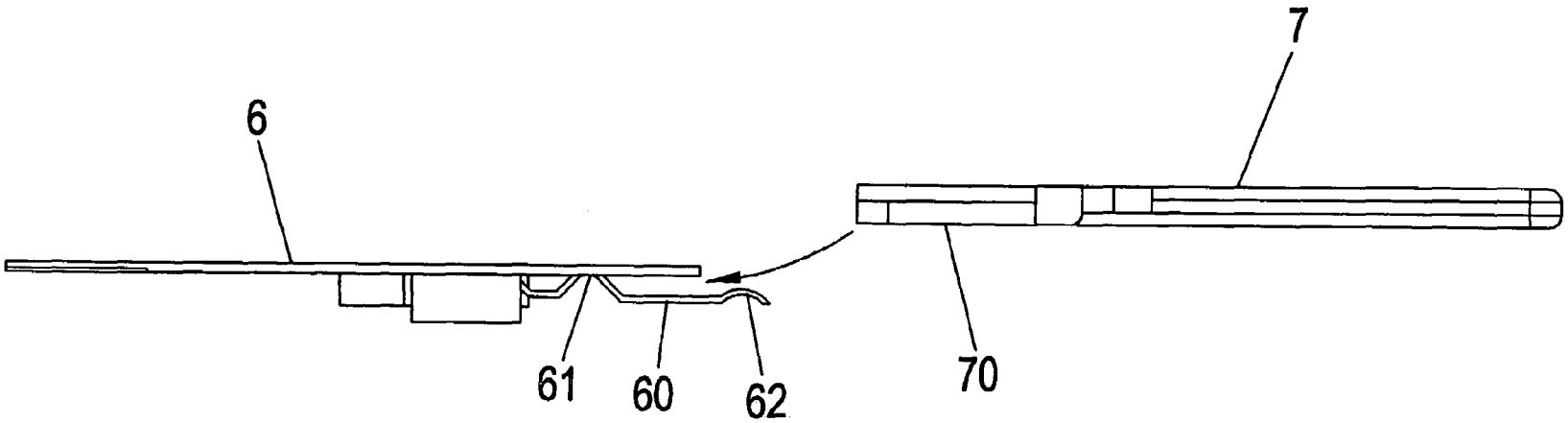
FIG. 7 is a schematic cross view of the present invention before insertion.
Figure 8:
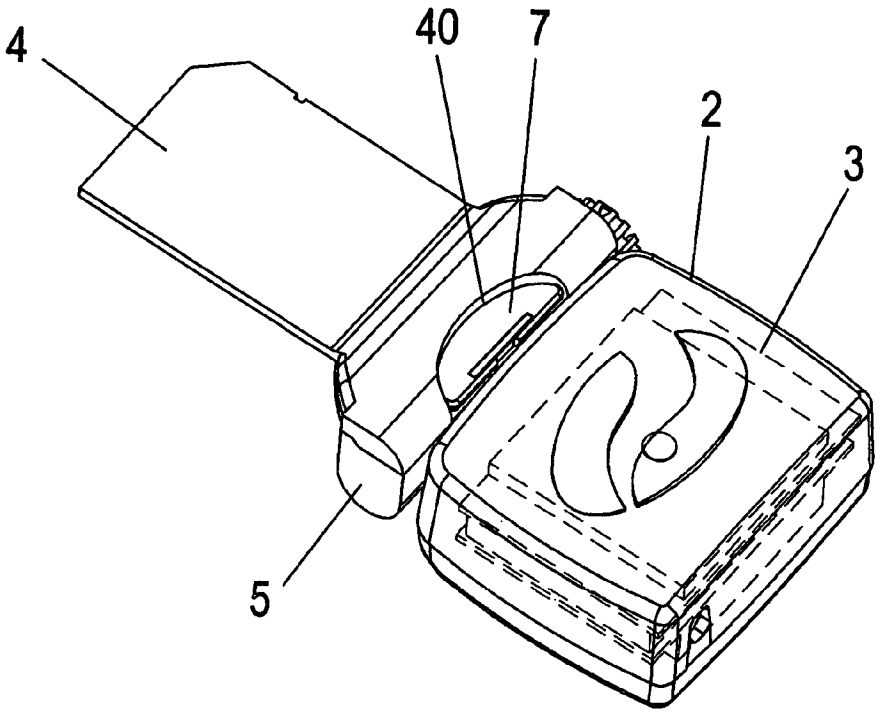
FIG. 8 is a schematic view of the present invention after insertion.
Figure 9:
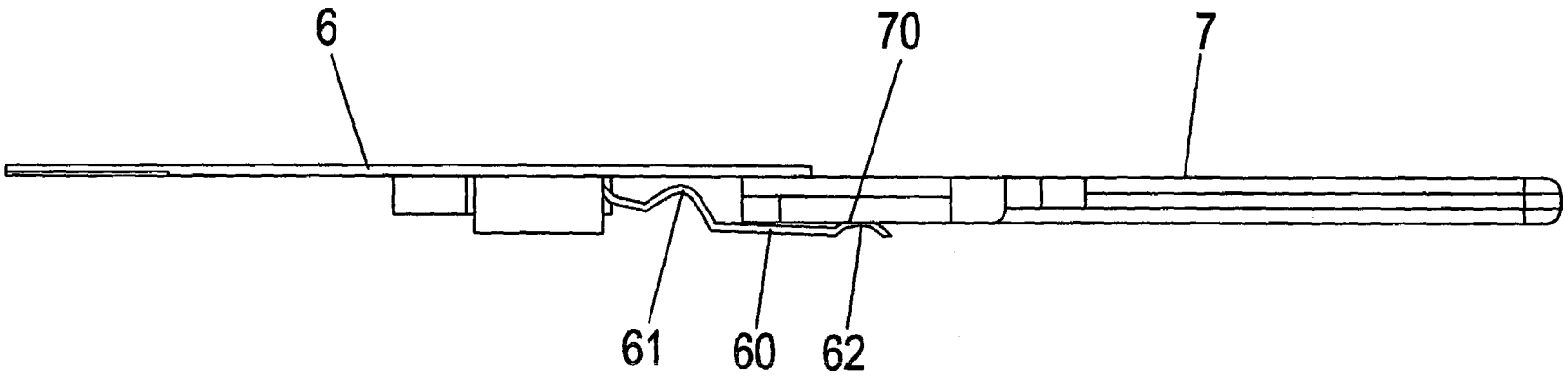
FIG. 9 is a schematic cross view of the present invention after insertion.
Figure 10:
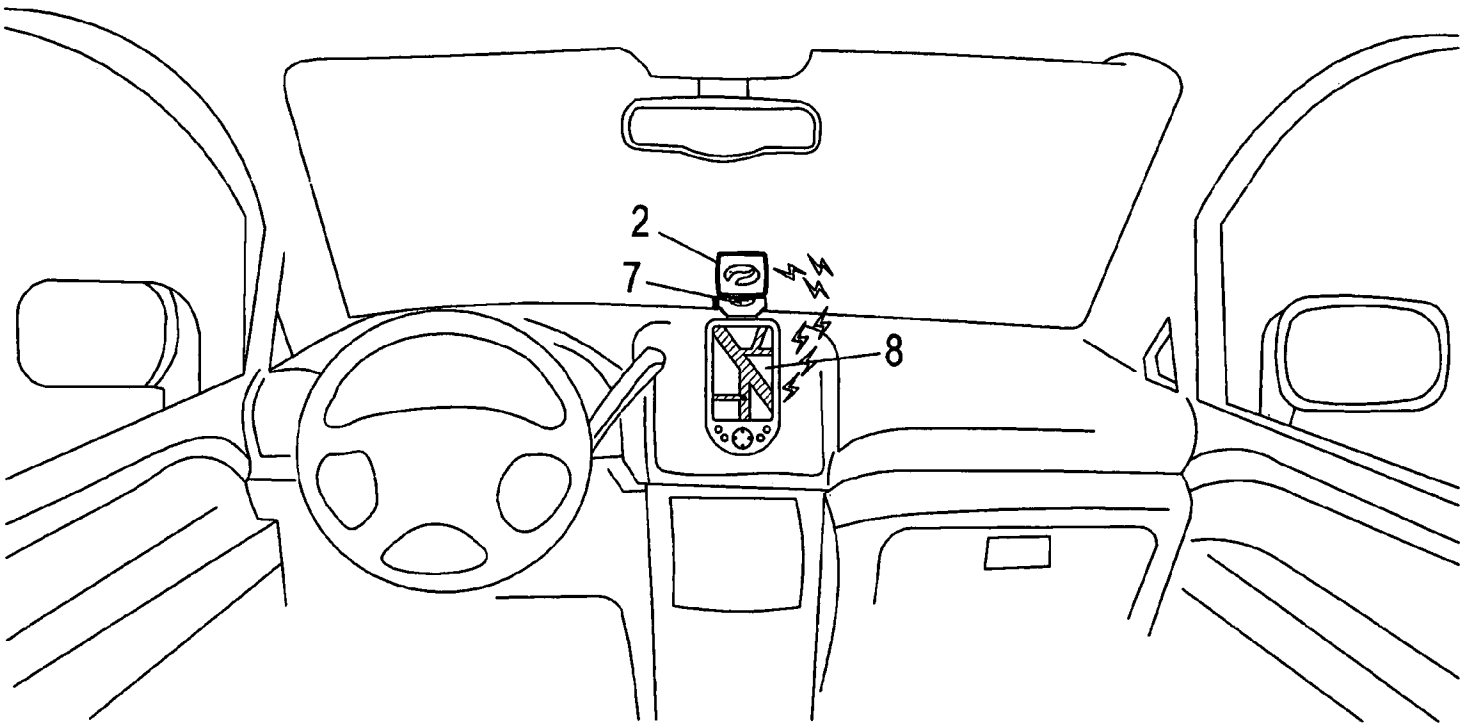
FIG. 10 shows one application of the present invention, where the present invention is used in within a car.

Referring to FIGS. 2–10, the structure of the present invention is illustrated. The present invention has the following elements.

A box 2 has one end extended with a shaft 20. Two ends of the shaft 20 have two connecting ends 200, 201, respectively.

A Blue tooth satellite receiver 3 is installed in the box 2

A lower cover 5 has two connecting ends 500, 501 at one side thereof. The connecting ends of the lower cover 5 are capable of connecting with the connecting ends 200, 201 of the box 2. Another side of the lower cover 5 has a pivotal end head 50. By rotating the pivotal head 50, the shaft 20 of the box 2 is separated from the lower cover 5.

An upper cover 4 is assembled with the lower cover 5 so as to form an inserting card 21. One side of the upper cover 4 is formed as a cambered concave edge 40. When the upper cover 4 is assembled to the lower cover 5. The cambered concave edge 40 is formed as an opening 400 for receiving an SD card 7.

A terminal retainer 6 is received in the space between the upper cover 4 and the lower cover 5. Two ends of the terminal retainer 6 are extended with respective power wires 600, 601 which are extended to the contact points 70 of the connecting end 500 of the lower cover 5 so as to supply power to the SD card 7. When the SD card is not installed, the present invention is purely an external-connected satellite receiver. The power wires 600, 601 serves to supply power to a handhold mobile device 8 from a contact point 210 at the connecting end 500. Furthermore, the power from the power wires 600, 601 can be supplied to the Blue tooth satellite receiver 3. An elastic terminal set 60 is installed at a bottom of the terminal retainer 6. A cambered contact arm 61 is protruded from the terminal retainer 6 for electronically contacting the terminal retainer 6. A cambered guide arm 62 extends forwards from the contact arm 61 for receiving the SD (secured digital) card 7. When the SD card 7 is inserted into the opening 400, the guide arm 62 will be pressed by the SD card 7 so that the contact arm 61 is separated from the terminal retainer 6. Meanwhile, the guide arm 62 will electronically contact the contact point 70 at a front surface of the SD card 7. When the inserting card 21 with the Blue tooth satellite receiver 3 is inserted into the slot 80 of the handhold mobile device 8. The handhold mobile device 8 can read data in the Blue tooth satellite receiver 3. When the SD card 7 is inserted into the opening 400 of the inserting card 21, the handhold mobile device 8 will read the data of electronic map stored in the SD card 7. Then the Blue tooth satellite receiver 3 will transfer satellite signals to the handhold mobile device 8 wirelessly. Thereby the electronic map is used with the satellite function.

Advantages of the present invention will be described herein. The present invention can be inserted into a handhold mobile device and is used with an electronic map needing a larger amount memory space. Thereby the electric map and the satellite can be used at the same time. As compared with other Blue tooth device, the present invention need not update battery and can be combined with a mobile device.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A satellite signal receiver used with blue tooth transmission and electronic maps comprising:

a box having one end extended with a shaft; two ends of the shaft having two connecting ends, respectively;

a Blue tooth satellite receiver installed in the box;

a lower cover having two connecting ends at one side thereof; the connecting ends of the lower cover being capable of connecting with the connecting ends of the box; another side of the lower cover having a pivotal head; by rotating the pivotal head, the shaft of the box being separated from the lower cover;

an upper cover assembled with the lower cover so as to form an inserting card; one side of the upper cover being formed as a cambered concave edge; when the upper cover is assembled to the lower cover; the cambered concave edge being formed as an opening for receiving an SD card;

a terminal retainer received in the space between the upper cover and the lower cover; two ends of the terminal retainer being extended with respective power wires which are extended to the contact points of the connecting end of the lower cover so as to supply power to the SD card;

an elastic terminal set is installed at a bottom of the terminal retainer; a cambered contact arm is protruded from the terminal retainer for electronically contacting the terminal retainer; a cambered guide arm extending forwards from the contact arm for receiving the SD (secured digital) card;

wherein when the SD card is not installed, it is functioned as a purely external-connected satellite receiver; the power wires serves to supply power to a handhold mobile device from a contact point at the connecting end; furthermore, the power from the power wires can be supplied to the Blue tooth satellite receiver; when the SD card is inserted into the opening, the guide arm will be pressed by the SD card so that the contact arm is separated from the terminal retainer; meanwhile, the guide arm will electronically contact the contact point at a front surface of the SD card; when the inserting card with the Blue tooth satellite receiver is inserted into the slot of the handhold mobile device; the handhold mobile device can read data in the Blue tooth satellite receiver; when the SD card is inserted into the opening of the inserting card, the handhold mobile device will read the data of electronic map stored in the SD card; and then the Blue tooth satellite receiver transfers satellite signals to the handhold mobile device wirelessly; thereby the electronic map is used with the satellite function.

* * * * *